US010208722B2

(12) United States Patent
Kato

(10) Patent No.: US 10,208,722 B2
(45) Date of Patent: Feb. 19, 2019

(54) FUEL INJECTION VALVE

(71) Applicant: DENSO CORPORATION, Kariya, Aichi-pref. (JP)

(72) Inventor: Noritsugu Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 169 days.

(21) Appl. No.: 15/312,049

(22) PCT Filed: May 26, 2015

(86) PCT No.: PCT/JP2015/002657
§ 371 (c)(1),
(2) Date: Nov. 17, 2016

(87) PCT Pub. No.: WO2015/182127
PCT Pub. Date: Dec. 3, 2015

(65) Prior Publication Data

US 2017/0082077 A1 Mar. 23, 2017

(30) Foreign Application Priority Data

May 28, 2014 (JP) ..... 2014-110298

(51) Int. Cl.
*F02M 51/06* (2006.01)
*F02M 61/18* (2006.01)

(52) U.S. Cl.
CPC ..... *F02M 51/06* (2013.01); *F02M 61/18* (2013.01); *F02M 61/1813* (2013.01); *F02M 61/1833* (2013.01)

(58) Field of Classification Search
CPC .. F02M 51/06; F02M 51/061; F02M 51/0625; F02M 51/0628; F02M 51/0664;
(Continued)

(56) References Cited

U.S. PATENT DOCUMENTS 5,540,200 A 7/1996 Naitoh et al.
7,159,802 B2 * 1/2007 Oomura ..... F02M 61/1846 239/533.12
(Continued)

FOREIGN PATENT DOCUMENTS

JP 2005-106006 4/2005
JP 2005-214165 8/2005
(Continued)

*Primary Examiner* — Darren W Gorman
(74) *Attorney, Agent, or Firm* — Nixon & Vanderhye P.C.

(57) ABSTRACT

A first injection hole included by an injection nozzle is formed such that an angle that a first virtual line passing a first inner-wall-side center point away from a center axis by a predetermined first distance, forms with the center axis becomes a first injection angle, and an angle that first injection hole inner walls form becomes a first open angle. A second injection hole included by the injection nozzle is formed such that an angle that a second virtual line passing a second inner-wall-side center point away from the center axis by a predetermined second distance, forms with the center axis becomes a second injection angle that is smaller than the first injection angle, and an angle that second injection hole inner walls form becomes a second open angle that is larger than the first open angle.

6 Claims, 3 Drawing Sheets

(58) Field of Classification Search
CPC ..... F02M 51/0685; F02M 61/18; F02M 61/1806; F02M 61/1813; F02M 61/182; F02M 61/1826; F02M 61/1833; F02M 61/1846
See application file for complete search history.

(56) References Cited

U.S. PATENT DOCUMENTS

| | | | | |
|---|---|---|---|---|
| 2007/0000476 | A1 | 1/2007 | Mizobuchi et al. | |
| 2007/0012805 | A1* | 1/2007 | Maier ..... | F02M 51/0671 239/533.12 |
| 2008/0196691 | A1 | 8/2008 | Kihara et al. | |
| 2008/0210198 | A1 | 9/2008 | Yamada et al. | |
| 2012/0305674 | A1 | 12/2012 | Buehner et al. | |
| 2015/0129687 | A1* | 5/2015 | Kaneta ..... | F02M 61/1806 239/585.5 |

FOREIGN PATENT DOCUMENTS

| | | |
|---|---|---|
| JP | 2007-085333 | 4/2007 |
| JP | 2009-103035 | 5/2009 |
| JP | 2010-185324 | 8/2010 |

* cited by examiner

FUEL INJECTION VALVE

CROSS REFERENCE TO RELATED APPLICATION

This application is the U.S. national phase of International Application No. PCT/JP2015/002657 filed May 26, 2015, which designated the U.S. and claims priority to Japanese Patent Application No. 2014-110298 filed on May 28, 2014, the entire contents of each of which are hereby incorporated by reference.

TECHNICAL FIELD

The present disclosure relates to a fuel injection valve for injecting and supplying fuel to an internal combustion engine.

BACKGROUND ART

In a conventional fuel injection valve, an injection hole in a housing is opened and closed by reciprocation of a needle to inject fuel in the housing to the outside. For example, Patent Literature 1 describes a fuel injection valve provided with a housing having injection holes with different inner diameters, which are provided according to position of a spark plug.

In the fuel injection valve described in Patent Literature 1, the inner diameter of the injection hole is constant from an inner opening formed in the inner wall of the housing to an outer opening formed in the outer wall of the housing. For this reason, different quantities of fuels flow in the injection holes having different inner diameters per unit time. Thus, fuel may not be reliably atomized in a combustion chamber. Unatomized droplet-like fuel in the fuel injected from the injection hole readily leads to imperfect combustion, possibly increasing the quantity of generated particulate matters.

PRIOR ART LITERATURES

Patent Literature

Patent Literature 1: JP2007-085333A

SUMMARY OF INVENTION

An object of the present disclosure is to provide a fuel injection valve capable of reducing the amount of particulate matters generated at burning of fuel.

According to an aspect of the present disclosure, the fuel injection valve includes a housing, a needle, a coil, a stator core, and a movable core. The housing includes a plurality of injection holes from which fuel is injected, a valve seat formed around the plurality of injection holes, an outer opening of the injection hole in an outer wall of the housing, an inner opening of the injection hole in an inner wall of the housing, and a first injection hole inner wall formed between the outer opening and the inner opening so as to increase a sectional area of the injection hole from the inner opening to the outer opening.

In the fuel injection valve of the present disclosure, an inner diameter of the outer opening of the injection hole is larger than an inner diameter of the inner opening of the injection hole. When a virtual plane including the valve seat is extended toward a center axis of the housing, the valve seat first intersects the first injection hole inner wall. Further, in the fuel injection valve of the present disclosure, as an injection angle as an angle that forms a injection hole axis with the center axis of the housing is smaller, an open angle is larger, and the open angle is an angle that a first straight line connecting the outer opening on the first injection hole inner wall to the inner opening forms with a second straight line connecting the outer opening on a second injection hole inner wall located on the opposite side to the first injection hole inner wall including the first straight line across the injection hole axis passing an inner-wall-side center point on the inner wall of the housing and a point on the center axis of the housing to the inner opening.

In general, in the fuel injection valve, the level of atomization of fuel is determined depending on characteristics of fuel flow in the injection hole. Specifically, as the surface area of liquid fuel flowing in the injection hole in contact with air becomes larger, and as the flow rate of fuel flowing in the injection hole is higher, the fuel is atomize more easily.

In the fuel injection valve of the present disclosure, one injection hole has a cone shape such that an outer opening of the one injection hole has an inner diameter larger than an inner diameter of an inner opening of the one injection hole. In each of a plurality of injection holes, when injection hole inner walls formed between the outer opening and the inner opening so as to increase the sectional area of the injection hole from the inner opening toward the outer opening are compared with each other, an open angle is an angle that a first straight line on the injection hole inner wall forms with a second straight line on the injection hole inner wall on the opposite side to the injection hole inner wall including the first straight line across the injection hole axis, and as an injection angle is smaller, the open angle becomes larger.

The injection angle of injection hole positively correlates with an impingement angle as an angle that is formed by a virtual plane including a valve seat and the injection hole inner wall of the injection hole. As the injection angle decreases, the flow rate of fuel flowing in the injection hole becomes higher. However, the impingement angle becomes smaller and thus, fuel is hard to be atomized. Therefore, in the fuel injection valve of the present disclosure, with regard to the injection hole having a relatively small impingement angle, that is, with regard to the injection hole having a relatively small injection angle, the open angle is relatively made larger to increase the surface area of liquid fuel flowing in the injection hole in contact with air. Consequently, in the fuel injection valve of the present disclosure, fuel flowing along the injection hole inner wall of the injection hole can be readily atomized, to reduce the quantity of droplet-like fuel generating particulate matters due to imperfect combustion.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Embodiments of the present disclosure will be described below with reference to the drawings.

(Embodiment)

Figure 1:
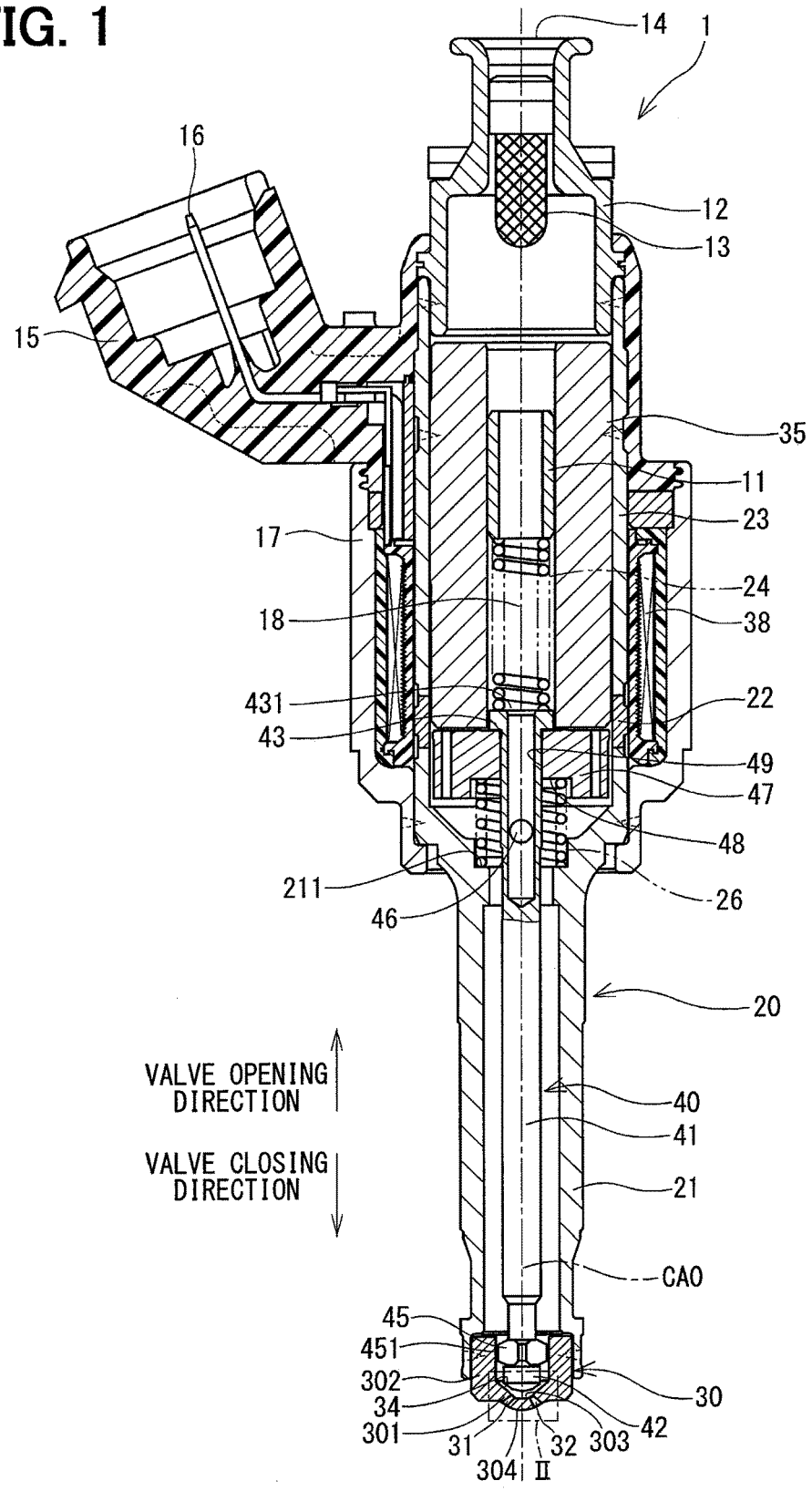
FIG. 1 is a cross-sectional view illustrating a fuel injection valve according to an embodiment of the present disclosure.
Figure 2:
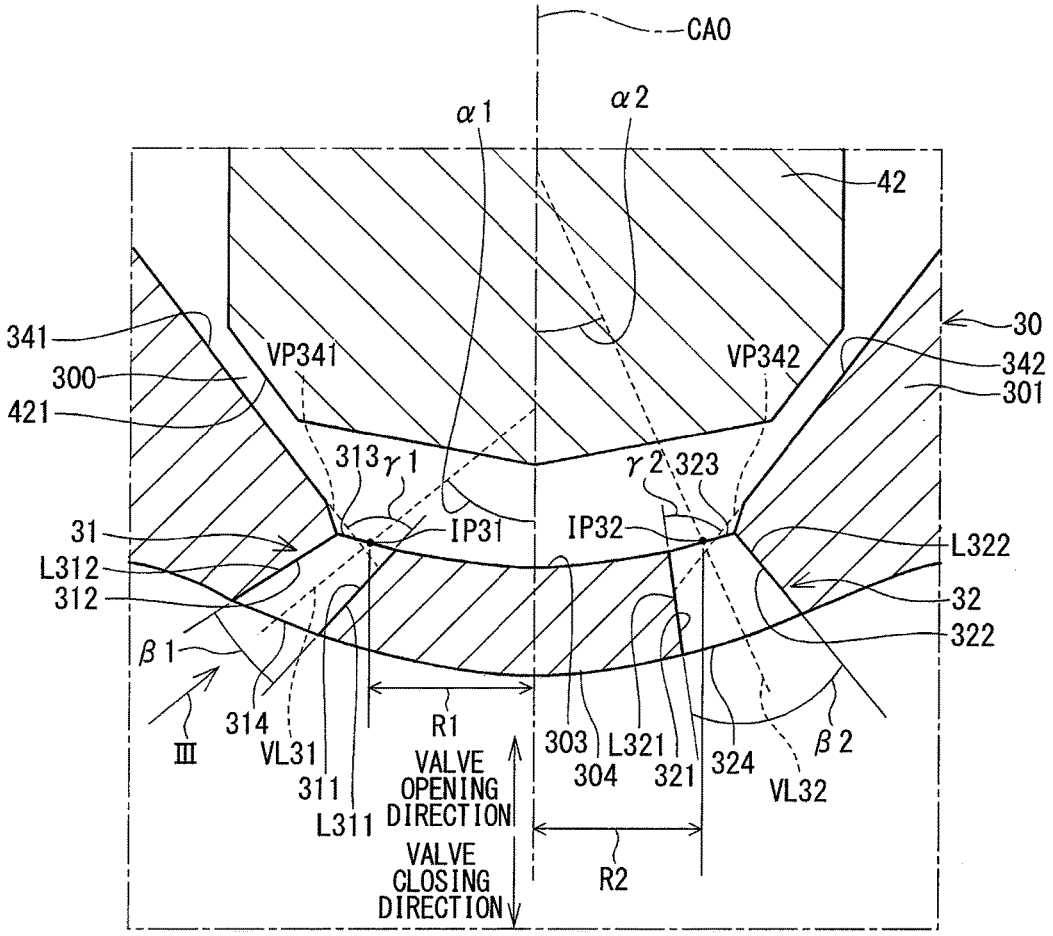
FIG. 2 is an enlarged view illustrating a portion II in FIG. 1.

FIGS. 1 and 2 illustrate a fuel injection valve 1 according to an embodiment of the present disclosure. FIGS. 1 and 2 depicts a valve opening direction in which a needle 40 is separated from a valve seat 34, and a valve closing direction in which the needle 40 contacts the valve seat 34.

The fuel injection valve 1 is used in, for example, a fuel injection device in a direct-injection gasoline engine not illustrated to inject and supply gasoline as fuel to the engine at higher pressure. In this case, the engine corresponds to an internal combustion engine. The fuel injection valve 1 includes a housing 20, the needle 40, a movable core 47, a stator core 35, a coil 38, a first spring 24, and a second spring 26.

As illustrated in FIG. 1, the housing 20 is configured of a first tubular member 21, a second tubular member 22, a third tubular member 23, and an injection nozzle 30. The first tubular member 21, the second tubular member 22, and the third tubular member 23 each are substantially cylindrical, and the first tubular member 21, the second tubular member 22, and the third tubular member 23 are coaxially connected to each other in this order.

The first tubular member 21 and the third tubular member 23 are made of a magnetic material such as ferritic stainless steel and the first tubular member 21 and the third tubular member 23 are magnetically stabilized. The first tubular member 21 and the third tubular member 23 have a relatively low hardness. The second tubular member 22 is made of, for example, a non-magnetic material such as austenitic stainless steel. The second tubular member 22 has a higher hardness than the first tubular member 21 and the third tubular member 23.

The injection nozzle 30 is provided at the first tubular member 21 on the opposite side to the second tubular member 22. The injection nozzle 30 is shaped like a closed-end tube made of metal such as martensitic stainless steel, and is welded to the first tubular member 21. The injection nozzle 30 is quenched to have a predetermined hardness. The injection nozzle 30 is configured of an injection portion 301 and a tubular portion 302.

The injection portion 301 is line-symmetric about a center axis CA0 of the housing 20, which is coaxial with the center axis of the fuel injection valve 1. A first outer wall 304 of the injection portion 301 protrudes along the center axis CA0. The injection portion 301 has a plurality of injection holes that communicates inside with outside of the housing 20. The valve seat 34 is formed on the edge of the inner opening that is an inner opening of the injection hole formed in an inner wall 303 of the injection portion 301.

The tubular portion 302 surrounds the outer radial side of the injection portion 301, and extends in the opposite direction to the direction in which the first outer wall 304 of the injection portion 301 protrudes. The tubular portion 302 has a first end connected to the injection portion 301 and a second end connected to the first tubular member 21.

The needle 40 is made of, for example, metal such as martensitic stainless steel. The needle 40 is quenched to have a predetermined hardness. The needle 40 has the almost same hardness as the hardness of the injection nozzle 30.

The needle 40 is reciprocatably accommodated in the housing 20. The needle 40 is configured of a shaft portion 41, a seal portion 42, and a to large-diameter portion 43. The shaft portion 41, the seal portion 42, and the large-diameter portion 43 are integrally formed.

The shaft portion 41 is a cylindrical rod. A sliding portion 45 is formed in the vicinity of the seal portion 42 of the shaft portion 41. The sliding portion 45 is substantially cylindrical, and a portion of a second outer wall 451 is chamfered. A non-chamfered portion of the second outer wall 451 of the sliding portion 45 can slide on the inner wall of the injection nozzle 30. Accordingly, the needle 40 is guided to reciprocate at an end on the side of the valve seat 34. The shaft portion 41 has a hole 46 that communicates the inner wall with the outer wall of the shaft portion 41.

The seal portion 42 is provided at the end of the shaft portion 41 on the side of the valve seat 34 so as to be capable of contacting the valve seat 34. In the needle 40, the seal portion 42 is separated from the valve seat 34 or contacts the valve seat 34 to open or close the injection hole, thereby allowing or suppressing communication between the inside and the outside of the housing 20.

The large-diameter portion 43 is provided on the shaft portion 41 on the opposite side to the seal portion 42. The large-diameter portion 43 has a diameter larger than the shaft portion 41. An end face of the large-diameter portion 43 on the side of the valve seat 34 is in contact with the movable core 47.

The needle 40 reciprocates in the housing 20 while the sliding portion 45 is supported by the inner wall of the injection nozzle 30, or the shaft portion 41 is supported by the inner wall of the second tubular member 22 via the movable core 47.

The movable core 47 is substantially cylindrical, is made of a magnetic material such as ferritic stainless steel, and is plated with, for example, chromium. The movable core 47 is magnetically stabilized. The hardness of the movable core 47 is relatively low, and is almost equal to the hardness of the first tubular member 21 and the third tubular member 23 of the housing 20. The movable core 47 has a through hole 49 at the substantial center thereof. The shaft portion 41 of the needle 40 is inserted into the through hole 49.

The stator core 35 is substantially cylindrical, and is made of a magnetic material such as ferritic stainless steel. The stator core 35 is magnetically stabilized. Although the stator core 35 has the almost same hardness as the movable core 47, in order to function as a stopper for the movable core 47, the stator core 35 is plated with, for example, chromium to ensure necessary hardness. The stator core 35 is welded to the third tubular member 23 of the housing 20 to be fixed to the inner side of the housing 20.

The coil 38 is substantially cylindrical, and surrounds mainly the outer radial side of the second tubular member 22 and the third tubular member 23. When electric power is supplied, the coil 38 forms a magnetic field. When the magnetic field is formed around the coil 38, then, the stator core 35, the movable core 47, the first tubular member 21, and the third tubular member 23 form a magnetic circuit. This generates a magnetic attraction force between the stator core 35 and the movable core 47 to attract the movable core 47 to the stator core 35. At this time, the needle 40 that abuts on the face of the movable core 47 on the opposite side to the valve seat 34 travels along with the movable core 47 toward the stator core 35, that is, in the valve opening direction.

The first spring 24 is provided such that a first end contacts a spring contact face 431 of the large-diameter portion 43. A second end of the first spring 24 is in contact with an end of an adjusting pipe 11 press-fitted into the stator core 35. The first spring 24 has an axially extending force.

Thus, the first spring 24 biases the needle 40 along with the movable core 47 toward the valve seat 34, that is, in the valve closing direction.

A first end of the second spring 26 contacts a first stepped face 48 of the movable core 47. A second end of the second spring 26 contacts a second stepped face 211 that is annular and is formed on the inner wall of the first tubular member 21 of the housing 20. The second spring 26 has an axially extending force. Thus, the second spring 26 biases the movable core 47 along with the needle 40 in the opposite direction to the valve seat 34, that is, valve opening direction.

In the present embodiment, a biasing force of the first spring 24 is set to be larger than a biasing force of the second spring 26. Thus, in the state where electric power is not fed to the coil 38, the seal portion 42 of the needle 40 is seated on the valve seat 34, that is, is in the valve closed state.

A fuel introduction pipe 12 that is substantially cylindrical is press-fitted into and welded to the end of the third tubular member 23 on the opposite side to the second tubular member 22. A filter 13 is provided on the inner side of the fuel introduction pipe 12. The filter 13 collects foreign matters contained in fuel flowing through an introduction port 14 of the fuel introduction pipe 12.

The outer radial sides of the fuel introduction pipe 12 and the third tubular member 23 are molded using resin. A connector 15 is formed on the molded portion. A terminal 16 for feeding electric power to the coil 38 is insert-molded to the connector 15. A tubular holder 17 that covers the coil 38 is provided on the outer radial side of the coil 38.

Fuel flowing through the introduction port 14 of the fuel introduction pipe 12 passes on the inner radial side of the stator core 35, in the adjusting pipe 11, on the inner side of the large-diameter portion 43 and the shaft portion 41 of the needle 40, in the hole 46, and a clearance between the first tubular member 21 and the shaft portion 41 of the needle 40, and the fuel is guided into the injection nozzle 30. That is, a portion from the introduction port 14 of the fuel introduction pipe 12 to the clearance between the first tubular member 21 and the shaft portion 41 of the needle 40 constitutes a fuel passage 18 that introduces fuel into the injection nozzle 30. To inject fuel directly to a combustion chamber of the engine, the pressure of fuel flowing in the fuel passage 18 is relatively high, and is set to 1 MPa or more in the fuel injection valve according to the embodiment.

The fuel injection valve 1 according to the embodiment is characterized by position and shape of injection holes formed in the injection nozzle 30. Here, referring to FIG. 2 that is a cross-sectional view of the fuel injection valve 1 taken along the center axis CA0, position and shape of the injection holes will be described below.

First, the shape of a first injection hole 31 will be described.

The first injection hole 31 is formed in the inner wall 303 of the injection portion 301 such that an angle that a first virtual line VL31, which is an injection hole axis passing a first inner-wall-side center point IP31 away from the center axis CA0 by a predetermined first distance R1 and a point on the center axis CA0, forms with the center axis CA0 becomes a first injection angle $\alpha 1$.

The first injection hole 31 has a circular cross section perpendicular to the first virtual line VL31. A first outer opening 314 in the first outer wall 304 has an inner diameter larger than an inner diameter of a first inner opening 313 in the inner wall 303. That is, the first injection hole 31 is formed into a cone shape such that the first injection hole 31 becomes smaller toward the inner side of the injection nozzle 30 when viewed from the outside of the fuel injection valve 1.

In the first injection hole 31, the injection hole inner wall forms a first open angle $\beta 1$ between the first inner opening 313 and the first outer opening 314 such that the sectional area of the first injection hole 31 increases from the first inner opening 313 toward the first outer opening 314.

Referring to FIG. 2 that is a cross-sectional view of the fuel injection valve 1 taken along the center axis CA0 and the first virtual line VL31, the first open angle $\beta 1$ will be specifically described below. Here, as a matter of convenience, the injection hole inner wall of the first injection hole 31, which is closer to the center axis CA0 than to the first virtual line VL31, is defined as a first injection hole inner wall 311 that is a first injection hole inner wall on which a first straight line is located, and the injection hole inner wall of the first injection hole 31, which is farther from the center axis CA0 than from the first virtual line VL31, is defined as a second injection hole inner wall 312 that is a second injection hole inner wall located on the opposite side to the first injection hole inner wall. At this time, as illustrated in FIG. 2, an angle that a first cross-sectional line L311 that is the first straight line on the first injection hole inner wall 311 forms with a second cross-sectional line L312 that is the second straight line on the second injection hole inner wall 312 becomes the first open angle $\beta 1$.

A first valve seat 341 is a portion of the valve seat 34, and is located on the opposite side to the center axis CA0 when viewed from the first injection hole 31. When a first virtual plane VP341 including the first valve seat 341 is extended toward the center axis CA0, the first virtual plane VP341 first intersects the first injection hole inner wall 311. In other words, when the first virtual plane VP341 is extended toward the center axis CA0, the first valve seat 341 directly intersects the first injection hole inner wall 311 without intersecting the second injection hole inner wall 312. At this time, as illustrated in FIG. 2, an angle that the first cross-sectional line L311 on the first injection hole inner wall 311 forms with the cross-sectional line on the first virtual plane VP341 becomes a first impingement angle $\gamma 1$ as an angle that the virtual plane forms with the injection hole inner wall forming the injection hole.

Next, shape of the second injection hole 32 will be described below.

The second injection hole 32 is formed in the inner wall 303 of the injection portion 301 such that an angle that a second virtual line VL32, which is an injection hole axis passing a second inner-wall-side center point IP32 away from the center axis CA0 by a predetermined second distance R2 and a point on the center axis CA0, forms with the center axis CA0 becomes a second injection angle $\alpha 2$ that is smaller than the first injection angle $\alpha 1$.

The second injection hole 32 has a circular cross section perpendicular to the second virtual line VL32. A second outer opening 324 in the first outer wall 304 is larger than a second inner opening 323 in the inner wall 303. That is, the second injection hole 32 is formed into a cone shape such that the second injection hole 32 becomes smaller toward the inner side of the injection nozzle 30 when viewed from the outside of the fuel injection valve 1.

In the second injection hole 32, the injection hole inner wall forms a second open angle $\beta 2$ between the second inner opening 323 and the second outer opening 324 such that the sectional area of the second injection hole 32 increases from the second inner opening 323 toward the second outer opening 324.

Referring to FIG. 2 that is a cross-sectional view of the fuel injection valve 1 taken along the center axis CA0 and the second virtual line VL32, the second open angle β2 will be specifically described below. Here, as a matter of convenience, the injection hole inner wall of the second injection hole 32, which is closer to the center axis CA0 than to the second virtual line VL32, is defined as a third injection hole inner wall 321 that is a first injection hole inner wall on which a first straight line is located, and the injection hole inner wall of the second injection hole 32, which is farther from the center axis CA0 than from the second virtual line VL32, is defined as a fourth injection hole inner wall 322 that is a second injection hole inner wall on the opposite side to the injection hole inner wall on which the first straight line is located. At this time, as illustrated in FIG. 2, an angle that the third cross-sectional line L321 that is the first straight line on the third injection hole inner wall 321 forms with the fourth cross-sectional line L322 that is the second straight line on the fourth injection hole inner wall 322 becomes the second open angle β2.

A second valve seat 342 is a portion of the valve seat 34, and is located on the opposite side to the center axis CA0 when viewed from the second injection hole 32. When a second virtual plane VP342 including the second valve seat 342 is extended toward the center axis CA0, the second virtual plane VP342 first intersects the third injection hole inner wall 321 of the second injection hole 32. In other words, when the second virtual plane VP341 is extended toward the center axis CA0, the second valve seat 342 directly intersects the third injection hole inner wall 321 without intersecting the fourth injection hole inner wall 322. At this time, as illustrated in FIG. 2, an angle that the third cross-sectional line L321 on the third injection hole inner wall 321 forms with the cross-sectional line on the second virtual plane VP342 becomes a second impingement angle γ2 as an angle that the virtual plane forms with the injection hole inner wall forming the injection hole.

Here, although the relationship among the injection angle, the open angle, and the impingement angle of only the two injection holes 31, 32 illustrated in FIG. 2 have been described, other injection holes formed in the injection nozzle 30 have the same relationship. That is, the injection hole having a larger injection angle has a smaller open angle and a larger impingement angle than the injection hole having a smaller injection angle.

Figure 3:
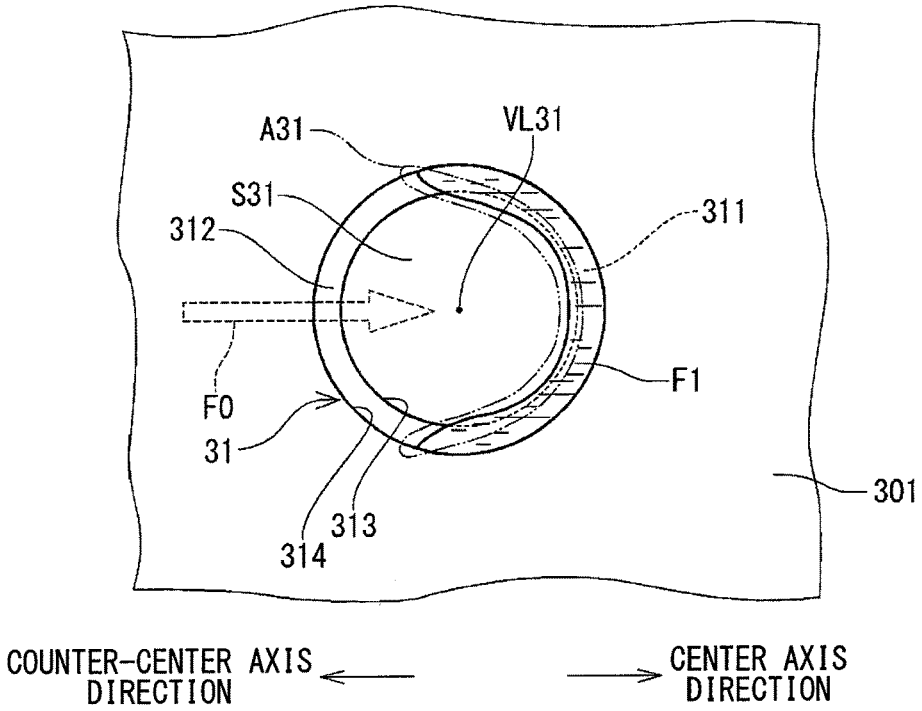
FIG. 3 is a view when viewed from an arrow III in FIG. 2.

FIG. 3 schematically illustrates a fuel flow at outward injection of fuel from the first injection hole 31 when viewed from the outer side of the first injection hole 31. In FIG. 3, for describing position of fuel flowing in the first injection hole 31, a direction of the center axis CA0 of the housing 20 with respect to the first injection hole 31 is defined as a center axis side, and the opposite side to the side of the center axis CA0 of the housing 20 with respect to the first injection hole 31 is defined as a counter-center axis side.

When the needle 40 is separated from the first valve seat 341, fuel passes between the first valve seat 341 and a valve seat contact face 421 of the seal portion 42, and flows along the first virtual plane VP341 (See FIG. 2). As represented by a hollow arrow F0, fuel flowing along the first virtual plane VP341 impinges on the first injection hole inner wall 311. At this time, fuel is pressed out of the fuel passage 18 by the pressure at retention in the fuel passage 18 and thus, as illustrated in FIG. 3, the fuel flows while being pressed onto the first injection hole inner wall 311. Accordingly, fuel F1 flows in the first injection hole 31 while being stuck to the first injection hole inner wall 311. However, since the fuel does not flow along the second injection hole inner wall 312 of the counter-center axis side, a space S31 is generated on the counter-center axis side of the first injection hole 31.

In the fuel injection valve that injects fuel from the injection hole to atomize the fuel, in order to improve fuel atomization, it is desirable to act a relatively large shear force onto fuel flowing in the injection hole. The shear force acting on fuel flowing in the injection hole is determined depending on a product of the surface area of the fuel flowing in the injection hole in contact with air, and the flow rate of the fuel.

In the fuel injection valve 1 according to the embodiment, out of the injection hole inner walls forming the injection hole, the injection hole inner wall located closer to the center axis CA0 includes the valve seat located on the counter-center axis side of the injection hole, and intersects the virtual plane extending toward the center axis CA0. Thus, when the needle 40 is separated from the valve seat 34 to form a clearance (for example, a clearance 300 in FIG. 2) between the valve seat 34 and a valve seat contact face of the needle 40, fuel flowing through the clearance directly impinges on the injection hole inner wall of the injection hole on the side of the center axis CA0, and flows while being pressed onto the injection hole inner wall. Accordingly, after the fuel flowing through the clearance impinges on the inner wall of the housing even once, the flow rate of the fuel decreases. As the impingement angle becomes larger, fuel pressed out through the clearance between the valve seat 34 and the valve seat contact face is pressed onto the injection hole inner wall more strongly. As a result, the surface area of fuel in contact with air, that is, an area surrounded with a two-dot chain line A31 in FIG. 3 becomes larger. Therefore, the fuel injection valve 1, in which fuel passing through the clearance between the valve seat 34 and the valve seat contact face directly impinges on the injection hole inner wall of the injection hole on the side of the center axis CA0, can atomize a relatively large quantity of fuel.

In the fuel injection valve 1 according to the embodiment, the open angle is adjusted according to the injection angle positively correlated with the impingement angle.

Figure 4:
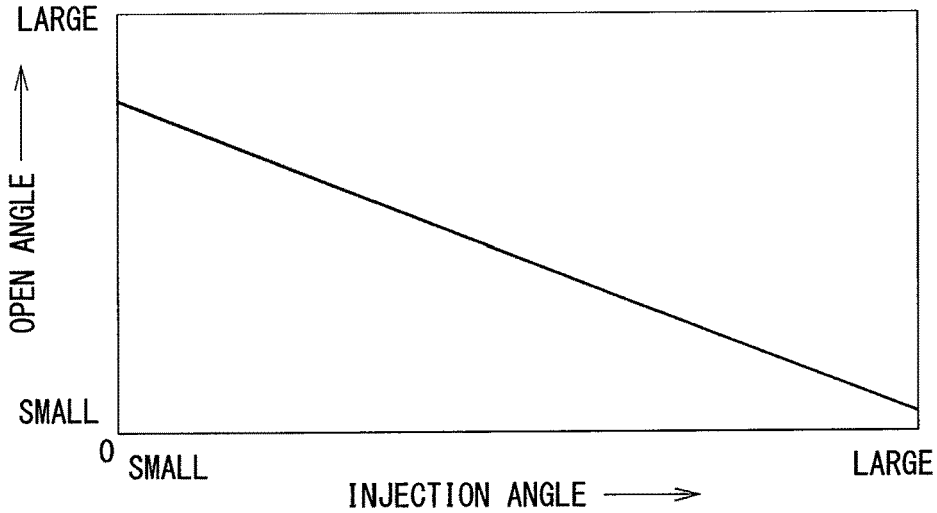
FIG. 4 is a characteristic diagram illustrating a relationship between an open angle and an injection angle of the fuel injection valve according to the embodiment of the present disclosure.

FIG. 4 illustrates a relationship between the injection angle and the open angle of the injection hole in the fuel injection valve 1. FIG. 4 illustrates calculation of the open angle that maximizes the shear force based on a relationship between the open angle and the shear force acting on the injection hole at any injection angle.

As illustrated in FIG. 4, as the injection angle of the injection hole increases, the open angle that maximizes the shear force becomes smaller. That is, using a large injection angle, even when the injection hole is formed such that the size of the inner diameter of the inner opening is close to the size of the inner diameter of the outer opening, the shear force acting on fuel becomes large, readily atomizing fuel. On the contrary, when the injection angle is small, by forming the injection hole such that the inner diameter of the outer opening is larger than the inner diameter of the inner opening, the shear force acting on fuel can be increased. In this manner, the open angle is changed according to the injection angle, atomizing a relatively large quantity of fuel in any of the plurality of injection holes.

As described above, in the fuel injection valve 1 according to the embodiment, fuel passing through the clearance between the valve seat 34 and the valve seat contact face can directly impinge on the injection hole inner wall on the side of the center axis CA0 out of the injection hole inner walls forming the injection hole, effectively utilizing the pressure of fuel in the fuel passage 18 to increase the surface area of the injection hole in contact with air. Even with the injection hole having a relatively small impingement angle, a relatively large shear force can be acted on fuel pressed onto the injection hole inner wall by increasing the open angle, to atomize a relatively large quantity of fuel. Thus, the fuel injection valve 1 according to the embodiment can atomize a relatively large quantity of fuel flowing in the injection hole. Since fuel atomization is promoted, the quantity of droplet-like fuel decreases, reducing the quantity of particulate matters generated at combustion of fuel.

(Other Embodiments)

(i) In the above-mentioned embodiment, the injection hole is formed such that as the impingement angle becomes larger, the open angle becomes smaller. However, the relationship between the impingement angle and the open angle is not limited to the above relationship. The virtual plane that includes the valve seat on the counter-center axis side of the injection hole and extends toward the center axis CA0 needs to intersect the injection hole inner wall on the side of the center axis out of the injection hole inner walls of the injection hole.

(ii) In the above-mentioned embodiment, the pressure of fuel flowing in the fuel passage is set to be 1 MPa or more. However, the fuel pressure is not limited to 1 MPa or more. The pressure may be any pressure at which fuel can be injected directly to the combustion chamber of the engine.

(iii) In the above-mentioned embodiment, the injection hole has a circular cross section. However, the cross-sectional shape of the injection hole is not limited to circle.

The present disclosure is not limited to the embodiments mentioned above, and can be applied to various embodiments within the spirit and scope of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel injection valve comprising:

a housing that is tubular and has a plurality of injection holes which is provided at one side in a center axis direction and from which fuel is injected, a valve seat formed around the plurality of injection holes, and a fuel passage in which fuel to be injected from one of the plurality of the injection holes flows;

a needle that is provided so as to be reciprocable in the center axis direction of the housing, the needle being separated from the valve seat or contacting the valve seat to open or close the one of the plurality of the injection holes;

a coil that forms a magnetic field when energized;

a stator core that is fixed within the magnetic field formed by the coil in the housing; and a movable core provided to be reciprocable in the center axis direction of the housing, the movable core being attracted along with the needle toward the stator core when the coil is energized, wherein an outer opening of the one of the plurality of the injection holes in an outer wall of the housing has an inner diameter larger than an inner diameter of an inner opening of the one of the plurality of the injection holes in an inner wall of the housing when a virtual plane including the valve seat is extended toward a center axis of the housing, the virtual plane first intersects a first injection hole inner wall formed between the outer opening and the inner opening so as to increase a sectional area of the one of the plurality of the injection holes from the inner opening to the outer opening, when an injection angle as an angle that forms a injection hole axis with the center axis of the housing becomes smaller, an open angle becomes larger, the open angle being an angle that a first straight line connecting the outer opening on the first injection hole inner wall to the inner opening forms with a second straight line connecting the outer opening on a second injection hole inner wall located on the opposite side to the first injection hole inner wall including the first straight line across the one of the plurality of the injection holes axis passing an inner-wall-side center point on the inner wall of the housing and a point on the center axis of the housing to the inner opening, two injection holes among the plurality of the injection holes which interpose the center axis of the housing therebetween have injection hole axes on a common planar surface including the center axis of the housing, and injection angles of the two injection holes are different from each other, and the one of the plurality of the injection holes is one of the two injection holes; and the one of the plurality of the injection holes is formed such that the open angle becomes larger when an impingement angle becomes smaller, the impingement angle being an angle that the virtual plane including a portion of the valve seat located on the opposite side to the center axis of the housing when viewed from the one of the plurality of the injection holes forms with the first injection hole inner wall of the one of the plurality of the injection holes.

2. The fuel injection valve according to claim 1, wherein a pressure of fuel injected from the one of the plurality of injection holes is 1 MPa or more.

3. The fuel injection valve according to claim 1, wherein when the virtual plane is extended toward the center axis of the housing, the virtual plane directly intersects the first injection hole inner wall without intersecting the second injection hole inner wall.

4. A fuel injection valve comprising:

a housing that is tubular and has a plurality of injection holes which is provided at one side in a center axis direction and from which fuel is injected, a valve seat formed around the plurality of injection holes, and a fuel passage in which fuel to be injected from one of the plurality of the injection holes flows;

a needle that is provided so as to be reciprocable in the center axis direction of the housing, the needle being separated from the valve seat or contacting the valve seat to open or close the one of the plurality of the injection holes;

a coil that forms a magnetic field when energized;

a stator core that is fixed within the magnetic field formed by the coil in the housing; and a movable core provided to be reciprocable in the center axis direction of the housing, the movable core being attracted along with the needle toward the stator core when the coil is energized, wherein an outer opening of the one of the plurality of the injection holes in the vicinity of an outer wall of the housing has an inner diameter larger than an inner diameter of an inner opening of the one of the plurality of the injection holes in an inner wall of the housing, when a virtual plane including the valve seat is extended toward a center axis of the housing, the virtual plane first intersects a first injection hole inner wall formed between the outer opening and the inner opening so as to increase a sectional area of the one of the plurality of the injection holes from the inner opening to the outer opening, when an injection angle as an angle that forms a injection hole axis with the center axis of the housing becomes smaller, an open angle becomes larger, the open angle being an angle that a first straight line connecting the outer opening on the first injection hole inner wall to the inner opening forms with a second straight line connecting the outer opening on a second injection hole inner wall located on the opposite side to the first injection hole inner wall including the first straight line across the one of the plurality of the injection holes axis passing an inner-wall-side center point on the inner wall of the housing and a point on the center axis of the housing to the inner opening, two injection holes among the injection holes which interpose the center axis of the housing therebetween have injection hole axes on a common planar surface including the center axis of the housing, and injection angles of the two injection holes are different from each other, and the one of the plurality of the injection holes is one of the two injection holes and the one of the plurality of the injection holes is formed such that the open angle becomes larger when an impingement angle becomes smaller, the impingement angle being an angle that the virtual plane including a portion of the valve seat located on the opposite side to the center axis of the housing when viewed from the one of the plurality of the injection holes forms with the first injection hole inner wall of the one of the plurality of the injection holes.

5. The fuel injection valve according to claim 4, wherein a pressure of fuel injected from the one of the plurality of the injection holes is 1 MPa or more.

6. The fuel injection valve according to claim 4, wherein when the virtual plane is extended toward the center axis of the housing, the virtual plane directly intersects the first injection hole inner wall without intersecting the second injection hole inner wall.

* * * * *